US011622422B2

(12) United States Patent
Park et al.

(10) Patent No.: US 11,622,422 B2
(45) Date of Patent: Apr. 4, 2023

(54) COOKING APPARATUS AND METHOD OF CONTROLLING THE SAME

(71) Applicant: Samsung Electronics Co., Ltd., Suwon-si (KR)

(72) Inventors: Nam Ju Park, Suwon-si (KR); Ji Woong Choi, Suwon-si (KR); Hyun Kwan Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 240 days.

(21) Appl. No.: 16/766,912

(22) PCT Filed: Nov. 22, 2018

(86) PCT No.: PCT/KR2018/014466
§ 371 (c)(1),
(2) Date: May 26, 2020

(87) PCT Pub. No.: WO2019/103493
PCT Pub. Date: May 31, 2019

(65) Prior Publication Data

US 2020/0374988 A1 Nov. 26, 2020

(30) Foreign Application Priority Data

Nov. 23, 2017 (KR) ..... 10-2017-0157509

(51) Int. Cl.
*H05B 6/06* (2006.01)
*H05B 6/12* (2006.01)

(52) U.S. Cl.
CPC ..... *H05B 6/062* (2013.01); *H05B 6/12* (2013.01)

(58) Field of Classification Search
CPC ..... H05B 6/062; H05B 6/12
See application file for complete search history.

(56) References Cited

U.S. PATENT DOCUMENTS 5,536,920 A 7/1996 Kwon
6,064,584 A 5/2000 Cornec et al.
(Continued)

FOREIGN PATENT DOCUMENTS

EP 2 939 499 B1 12/2016
EP 3 042 541 B1 6/2017
(Continued)

OTHER PUBLICATIONS

Korean Office Action dated Jul. 5, 2021, issued in Korean Application No. 10-2017-0157509.
(Continued)

*Primary Examiner* — Dana Ross
*Assistant Examiner* — Kuangyue Chen
(74) *Attorney, Agent, or Firm* — Jefferson IP Law, LLP

(57) ABSTRACT

The present disclosure relates to a cooking apparatus and a method of controlling the same, and more particularly, to a technology for reducing stress caused by a current flowing through a diode included in the cooking apparatus. The cooking apparatus includes a coil on which a vessel is mounted, configured to form a magnetic field upon application of a current; a first switch and a second switch configured to change a direction of the current flowing through the coil; a first diode connected in parallel to the first switch or a second diode connected in parallel to the second switch; and a controller configured to alternately control a turn-on operation of the first switch and the second switch, and when a maximum value of the current flowing through the first diode or a maximum value of the current flowing through the second diode exceeds a predetermined value, to increase an operating frequency of turning on the first switch and the second switch to limit the maximum value of the current flowing through the first diode or the second diode to less than or equal to the predetermined value.

16 Claims, 15 Drawing Sheets

(56) References Cited

U.S. PATENT DOCUMENTS

| | | | | |
|---|---|---|---|---|
| 2015/0229245 | A1* | 8/2015 | Cho | H02P 21/22 318/400.02 |
| 2017/0227902 | A1* | 8/2017 | Tomishima | G03G 15/2039 |

FOREIGN PATENT DOCUMENTS

| | | | | |
|---|---|---|---|---|
| JP | 2007-018789 | A | | 1/2007 |
| JP | 2007018789 | A | * | 1/2007 |
| JP | 2010-027472 | A | | 2/2010 |
| JP | 2016-085277 | A | | 5/2016 |
| KR | 10-2015-0084617 | A | | 7/2015 |
| KR | 10-2017-0113633 | A | | 10/2017 |
| WO | 2016/010491 | A1 | | 1/2016 |

OTHER PUBLICATIONS

Korean Notice of Patent Allowance dated Jan. 21, 2022, issued in Korean Application No. 10-2017-0157509.

St; A single plate induction cooker with ST7FLITE09; AN2383 Application Note; STMicroelectronics; Sep. 2006.

European Notice of Opposition dated Nov. 30, 2022; European Appln. No. 18880302.7-1202 / 3700297.

* cited by examiner

COOKING APPARATUS AND METHOD OF CONTROLLING THE SAME

TECHNICAL FIELD

The present disclosure relates to a cooking apparatus and a method of controlling the same, and more particularly, to a technology for reducing stress caused by a current flowing through a diode included in the cooking apparatus.

BACKGROUND ART

Generally, an induction heating cooking apparatus is a cooking appliance for heating a cooking vessel using the principle of induction heating. The induction heating cooking apparatus includes a cooking plate on which the cooking vessel is placed, and an induction heating coil to generate a magnetic field when a current is applied thereto.

If the current is applied to the induction heating coil to generate the magnetic field, a secondary current is induced to the cooking vessel, and Joule heat is generated due to resistance components of the cooking vessel. Accordingly, the cooking vessel is heated by the Joule heat so that food contained in the cooking vessel is cooked.

The induction heating cooking apparatus has some advantages in that the cooking vessel can be more rapidly heated than a case with a gas range or a kerosene cooking stove in which a fossil fuel such as gas or oil is burned to heat a cooking vessel using combustion heat and a harmful gas is not generated and there is no risk of fire.

Recently, in order to protect an element by minimizing stress caused by the current when a current greater than a rating of a switch or a diode included in the cooking apparatus flows, there is an increasing need to limit the current flowing through the element.

DISCLOSURE

Technical Problem

An aspect of the present disclosure is to detect a current flowing through a diode included in a cooking apparatus and to limit the current within a rating when a current greater than the diode's rating flows, thereby reducing stress caused by the current flowing through an element.

Technical Solution

An aspect of the present disclosure provides a cooking apparatus including:

a coil on which a vessel is mounted, configured to form a magnetic field upon application of a current; a first switch and a second switch configured to change a direction of the current flowing through the coil; a first diode connected in parallel to the first switch or a second diode connected in parallel to the second switch; and a controller configured to alternately control a turn-on operation of the first switch and the second switch, and when a maximum value of the current flowing through the first diode or a maximum value of the current flowing through the second diode exceeds a predetermined value, to increase an operating frequency of turning on the first switch and the second switch and limit the maximum value of the current flowing through the first diode or the second diode to less than or equal to the predetermined value.

The controller may be configured to determine a zero cross point (ZCP) of the current flowing through the coil.

The controller may be configured to determine a free-wheeling section in which the current flows in the first diode or the second diode based on a point at which the first switch and the second switch alternately turn on and the determined ZCP.

The controller may be configured to determine from a turn-off point of the first switch to an end point of the ZCP as the free-wheeling section in which the current flows in the second diode based on a current phase at the turn-off point of the first switch and a current phase at the end point of the ZCP.

The controller may be configured to determine from a turn-off point of the second switch to a start point of the ZCP as the free-wheeling section in which the current flows in the first diode based on a current phase at the turn-off point of the second switch and a current phase at the start point of the ZCP.

The controller may be configured to determine the maximum value of the current flowing through the first diode or the maximum value of the current flowing through the second diode in the free-wheeling section, and to compare the maximum value of the determined current with the predetermined value.

The cooking apparatus may further include a current detector configured to detect the current flowing in the coil. The current detector may be configured to detect the maximum value of the current flowing through the first diode or the maximum value of the current flowing through the second diode in the free-wheeling section.

The cooking apparatus may further include a signal generator configured to generate an operating frequency for operating the first switch and the second switch.

The signal generator may be configured to generate an increased operating frequency at a preset frequency under the control of the controller, and to apply the increased operating frequency to a gate end of the first switch and a gate end of the second switch.

Another aspect of the present disclosure provides a method of controlling a cooking apparatus, the cooking apparatus includes a coil configured to form a magnetic field according to an application of a current. The method including: alternately controlling, by a controller, a turn-on operation of a first switch and a second switch; determining, by the controller, a maximum value of the current flowing through a first diode connected in parallel to the first switch or a maximum value of the current flowing through a second diode connected in parallel to the second switch; and when the maximum value of the determined current exceeds a predetermined value, increasing, by the controller, an operating frequency of turning on the first switch and the second switch and limiting the maximum value of the current flowing through the first diode or the second diode to less than or equal to the predetermined value.

The method may further include determining, by the controller, a zero cross point (ZCP) of the current flowing through the coil.

The method may further include determining, by the controller, a free-wheeling section in which the current flows in the first diode or the second diode based on a point at which the first switch and the second switch alternately turn on and the determined ZCP.

The determining of the free-wheeling section may include determining from a turn-off point of the first switch to an end point of the ZCP as the free-wheeling section in which the current flows in the second diode based on a current phase at the turn-off point of the first switch and a current phase at the end point of the ZCP.

The determining of the free-wheeling section may include determining from a turn-off point of the second switch to a start point of the ZCP as the free-wheeling section in which the current flows in the first diode based on a current phase at the turn-off point of the second switch and a current phase at the start point of the ZCP.

The determining of the maximum value of the current may include determining the maximum value of the current flowing through the first diode or the maximum value of the current flowing through the second diode in the free-wheeling section; and comparing the maximum value of the determined current with the predetermined value.

The method may further include detecting, by a current detector, the current flowing in the coil. The detecting of the current may include detecting the maximum value of the current flowing through the first diode or the maximum value of the current flowing through the second diode in the free-wheeling section.

The alternately controlling of the turn-on operation of the first switch and the second switch may include generating an operating frequency for operating the first switch and the second switch.

The limiting of the maximum value of the current flowing through the first diode or the second diode to less than or equal to the predetermined value may include applying the increased operating frequency to a gate end of the first switch and a gate end of the second switch.

Advantageous Effects

According to an aspect of an embodiment, there is an effect of detecting a current flowing through a diode included in a cooking apparatus and limiting the current within the rating when a current greater than the diode's rating flows, thereby reducing stress caused by the current flowing through an element. In addition, by limiting the current flowing to the element within the rating for various cooking apparatuses, there is an effect that secures stability and is independent of a size and type of the cooking apparatus.

MODES OF THE INVENTION

Figure 1:
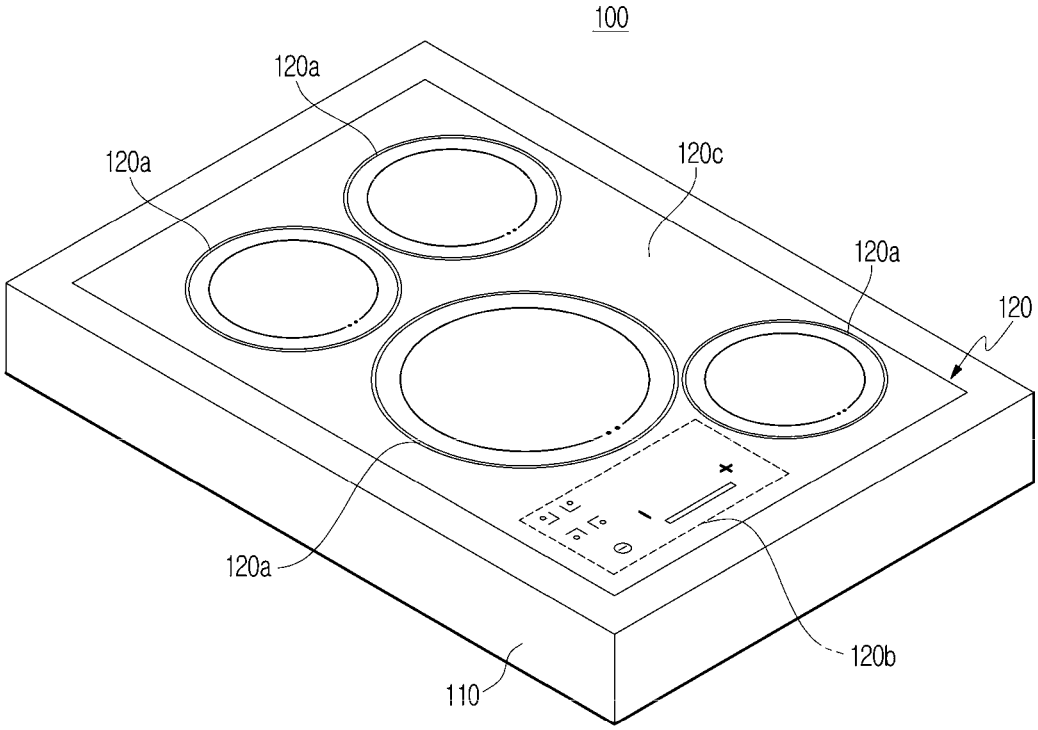
FIG. 1 is an external view of a cooking apparatus according to an embodiment.

Like reference numerals refer to like elements throughout the specification. Not all elements of embodiments of the present disclosure will be described, and description of what are commonly known in the art or what overlap each other in the embodiments will be omitted. The terms as used throughout the specification, such as "~part," "~module," "~member," "~block," etc., may be implemented in software and/or hardware, and a plurality of "~parts," "~modules," "~members," or "~blocks" may be implemented in a single element, or a single "~part," "~module," "~member," or "~block" may include a plurality of elements.

It will be understood that when an element is referred to as being "connected" to another element, it can be directly or indirectly connected to the other element, wherein the indirect connection includes "connection" via a wireless communication network.

Also, when a part "includes" or "comprises" an element, unless there is a particular description contrary thereto, the part may further include other elements, not excluding the other elements.

It will be understood that, although the terms first, second, third, etc., may be used herein to describe various elements, it should not be limited by these terms. These terms are only used to distinguish one element from another element.

As used herein, the singular forms "a," "an" and "the" are intended to include the plural forms as well, unless the context clearly indicates otherwise.

An identification code is used for the convenience of the description but is not intended to illustrate the order of each step. Each of the steps may be implemented in an order different from the illustrated order unless the context clearly indicates otherwise.

Hereinafter, operation principles and embodiments of the present disclosure will be described with reference to the accompanying drawings.

Figure 2:
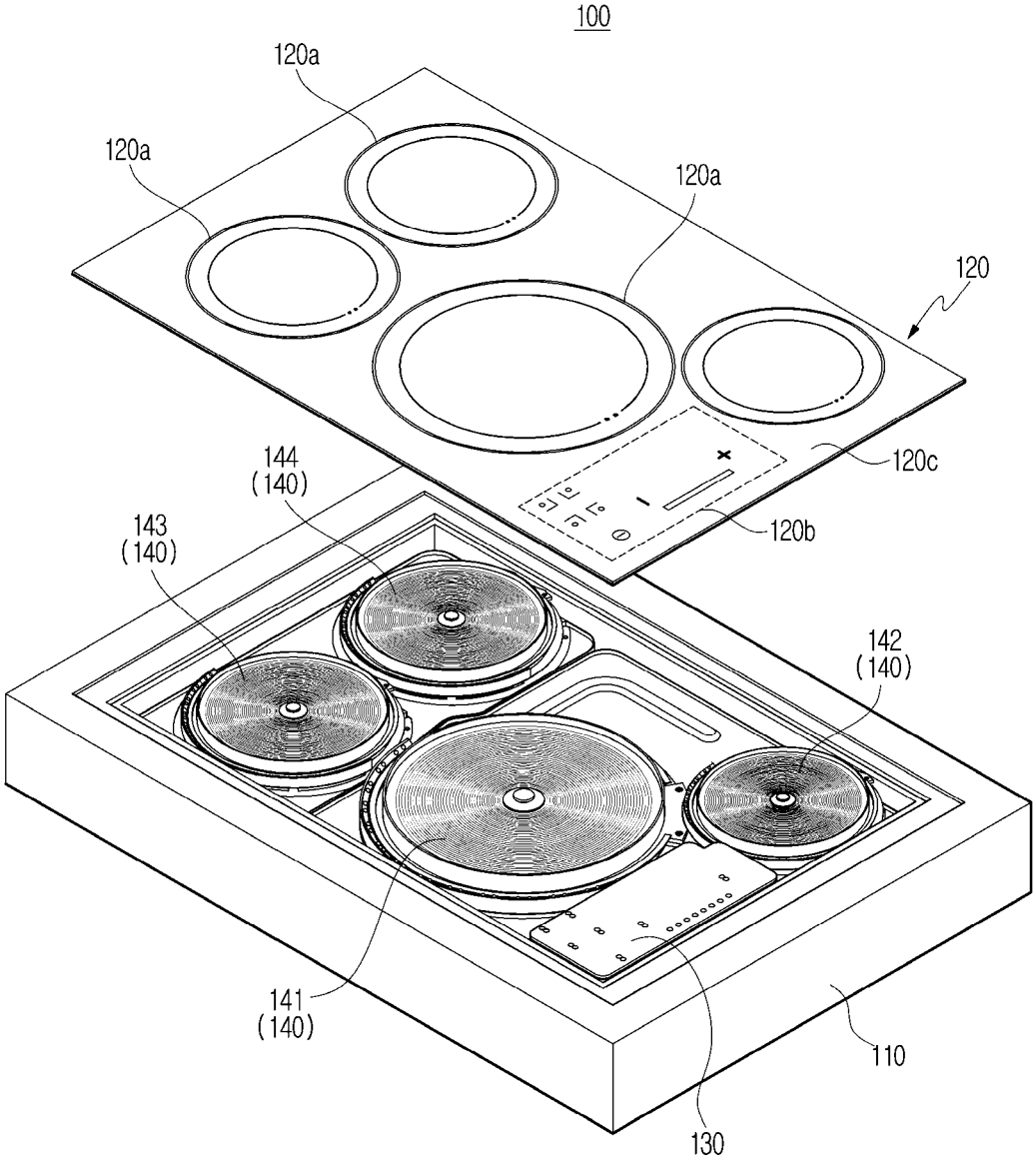
FIG. 2 is a view illustrating an interior of a cooking apparatus according to an embodiment.
Figure 3:
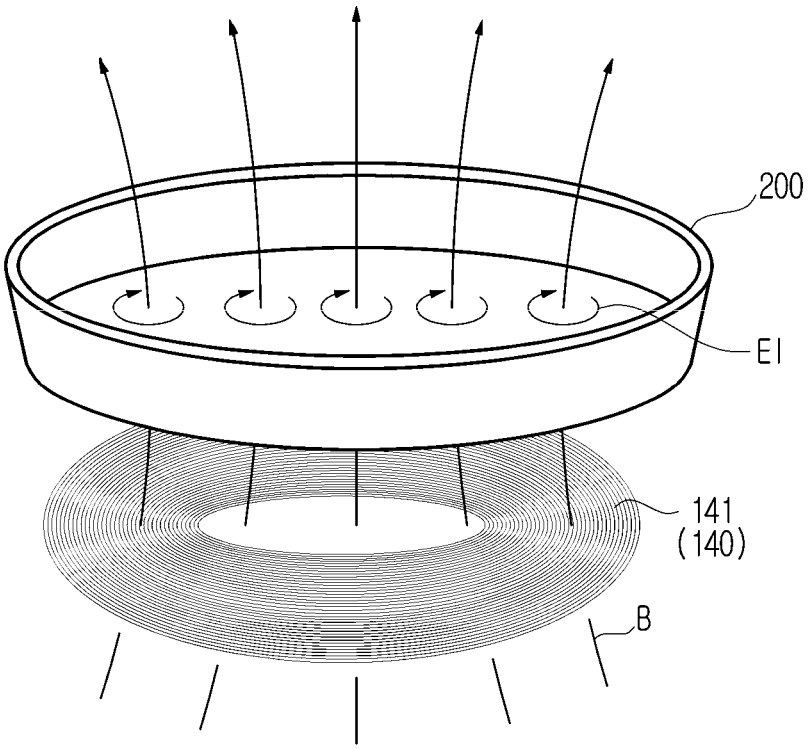
FIG. 3 is a view illustrating a principle of heating a vessel by a cooking apparatus according to an embodiment.

FIG. 1 is an external view of a cooking apparatus according to an embodiment, FIG. 2 is a view illustrating an interior of a cooking apparatus according to an embodiment, and FIG. 3 is a view illustrating a principle of heating a vessel by a cooking apparatus according to an embodiment.

Referring to FIG. 1, a cooking apparatus 100 may include a main body 110 which forms an exterior of the cooking apparatus 100 and is provided with various components constituting the cooking apparatus 100.

An upper surface of the main body 110 may be provided with a cooking plate 120 having a flat plate shape on which a cooking vessel can be placed.

The cooking plate 120 may be made of tempered glass such as ceramic glass so as not to be easily broken.

The cooking plate 120 may include a first area 120*a*, which corresponds to a position of at least one coil and is an area where the vessel is to be mounted, a second area 120*b* in which an operation command of the cooking apparatus 100 is input and operation information is output, and a third area 120*c* which is an area excluding the first area 120*a* and the second area 120*b* of the entire area.

Here, a coil position mark indicating a mounting position of the vessel may be formed in the first area 120*a*, and an input/output position mark indicating an input/output position may be formed in the second area 120*b*.

As illustrated in FIG. 2, a user interface 130, a coil device 140, and a driving circuit 150 may be provided in a space that is a lower portion of the cooking plate 120 and is inside the main body 110.

The user interface 130 may include an inputter that receives the operation command from a user, and an outputter that outputs the operation information of the cooking apparatus.

The outputter may include at least one of a display that outputs the operation information as an optical light or an image, and a sound outputter that outputs the operation information as a sound.

The inputter of the user interface 130 may include a touch panel that recognizes a touch position. The display may include a display panel integrally provided with the touch panel.

That is, the user interface 130 may be provided as a touch screen in which the touch panel and the display panel are integrated, and the image of the touch screen may be projected to the outside through the second area 120*b* of the cooking plate 120.

The inputter of the user interface 130 may include a plurality of touch pads for recognizing where to touch. The display may include at least one of a plurality of light emitting diodes and a plurality of seven segment displays.

The plurality of touch pads may receive a touch signal for power on/off, a touch signal for selecting the coil position, and a touch signal for selecting an output level.

Also, the inputter of the user interface 130 may be provided with at least one button, a switch, or at least one jog dial.

The plurality of light emitting diodes may be provided adjacent to the plurality of touch pads, and may display power on/off information, coil selection information, and coil output level information.

Here, light emitted from the plurality of light emitting diodes may be output to the outside through the second area 120*b* of the cooking plate 120.

In addition, a symbol of the operation command indicating the input position of the operation command may be formed in the second area 120*b* of the cooking plate 120, and a symbol of the operation information indicating the size of the output level may be formed.

For example, the symbol of the operation command may include a power on/off symbol and a position symbol of the coil, and the symbol of the operation information may include an increase/decrease symbol of the output level.

In addition, the user interface 130 may be provided at various positions, such as the front or side of the main body 110.

The coil device 140 may include a plurality of coils 141, 142, 143, and 144.

Here, the plurality of coils 141, 142, 143, and 144 may be provided in an interior space of the main body 110, but may be provided at a position corresponding to the coil position mark of the first area 120*a* of the cooking plate 120.

The plurality of coils 141, 142, 143, and 144 of the coil device 140 may have the same size and number of windings.

In addition, the plurality of coils 141, 142, 143, and 144 of the coil device 140 may be different from each other in size and number of windings, and accordingly, a maximum output level may be different from each other.

In addition, the coil of the coil device 140 may be one.

Each coil of the coil device 140 may form a magnetic field when a current is supplied, so that the vessel is heated by the formed magnetic field.

This will be described in more detail with reference to FIG. 3.

Here, a principle of all coils heating the vessel is the same. Therefore, the principle of heating the vessel in the first coil 141 among the plurality of coils will be described.

As illustrated in FIG. 3, the first coil 141 may generate a magnetic field B passing through the inside of the coil according to Ampere's law when current is supplied to a wound wire.

At this time, the magnetic field B generated in the first coil 141 may pass through the bottom surface of a vessel 200.

The current applied to the first coil 141 is a current whose direction changes with time, that is, an alternating current.

Accordingly, the magnetic field generated in the first coil 141 may also change with time.

That is, when the magnetic field B that changes with time passes through the inside of the first coil 141, the current rotating around the magnetic field B may be generated inside the bottom surface of the vessel 200.

Here, the current rotating around the magnetic field is a current formed by a voltage generated in a direction to prevent a change in the magnetic field B of the first coil 141, and may be called an eddy current EI.

The bottom surface of the vessel 200 may be heated by the eddy current EI.

In other words, when the eddy current EI flows through the vessel 200 having electrical resistance, heat is generated according to Ohm's law, whereby the vessel 200 may be heated.

Here, a phenomenon in which the current is induced by the magnetic field B that changes with time may be called an electromagnetic induction phenomenon.

As described above, the cooking apparatus 100 may selectively supply the current to at least one of the plurality of coils 141, 142, 143, and 144, and may heat the vessel 200 using the magnetic field B generated by the at least one coil.

Here, the at least one coil supplying the current may be a coil selected by the user, or a coil disposed at the detected position after detecting the position where the vessel 200 is mounted.

Figure 4:
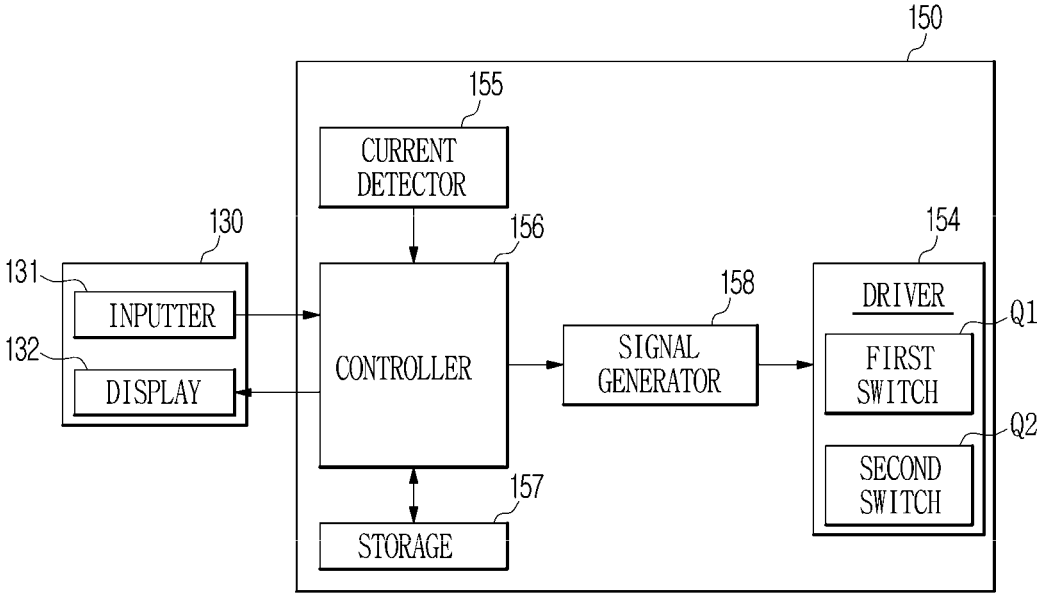
FIG. 4 is a control block diagram of a cooking apparatus according to an embodiment.
Figure 5:
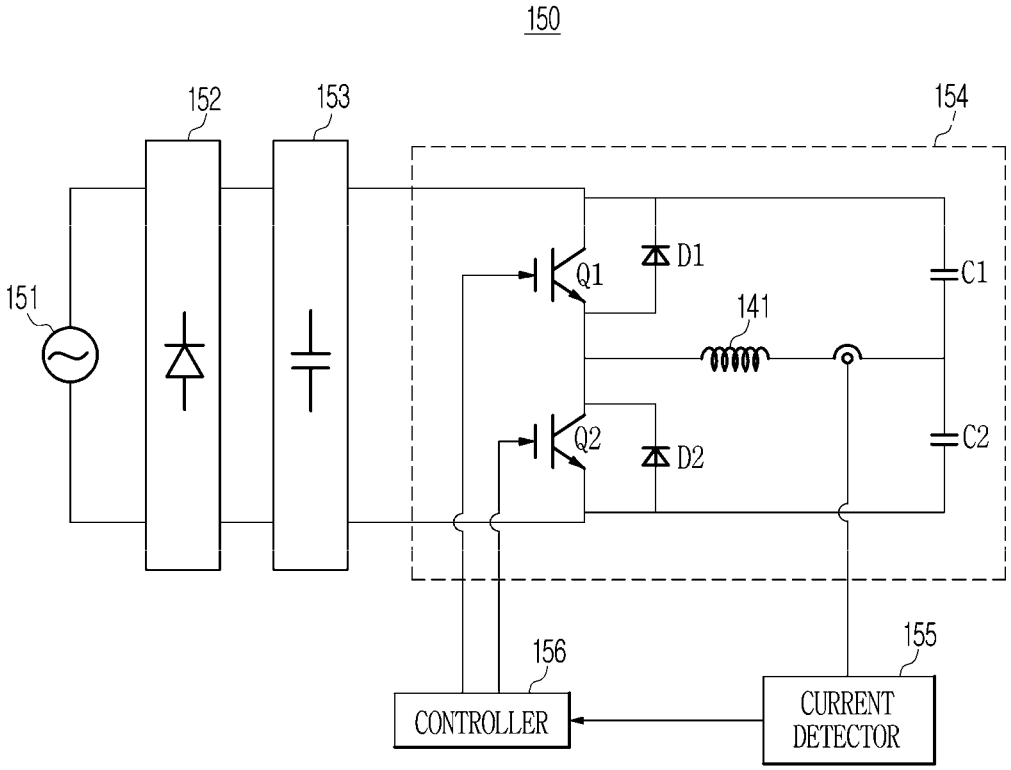
FIG. 5 is a view illustrating a detailed configuration of a driving circuit provided in a cooking apparatus according to an embodiment.
Figure 10:
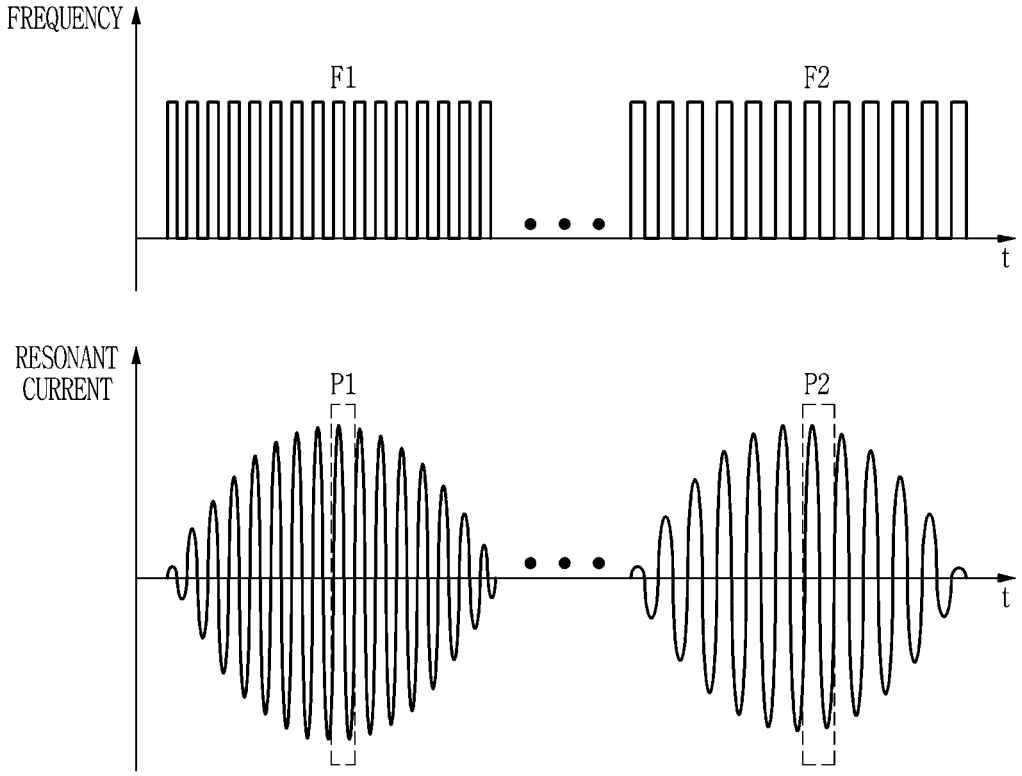
FIG. 10 is an exemplary view of a current waveform according to a frequency of a cooking apparatus according to an embodiment.
Figure 11:
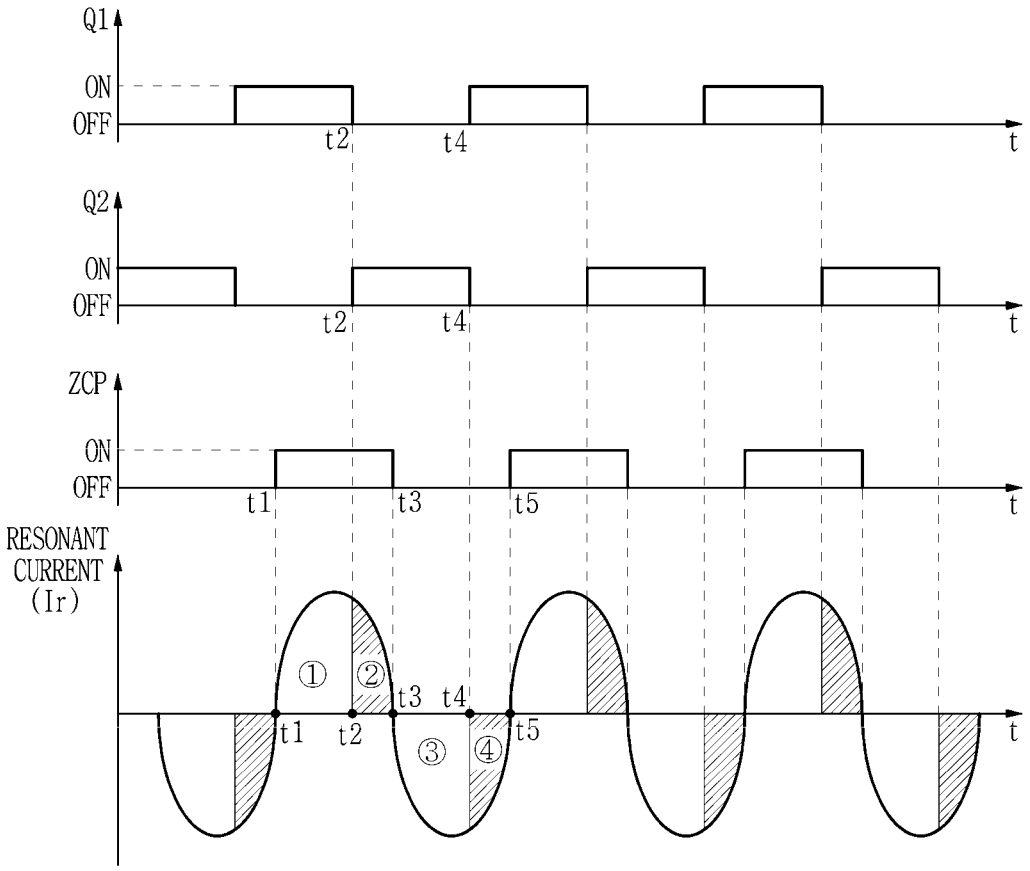
FIG. 11 is an exemplary view of a free-wheeling section of a current by switching according to an embodiment.
Figure 12:
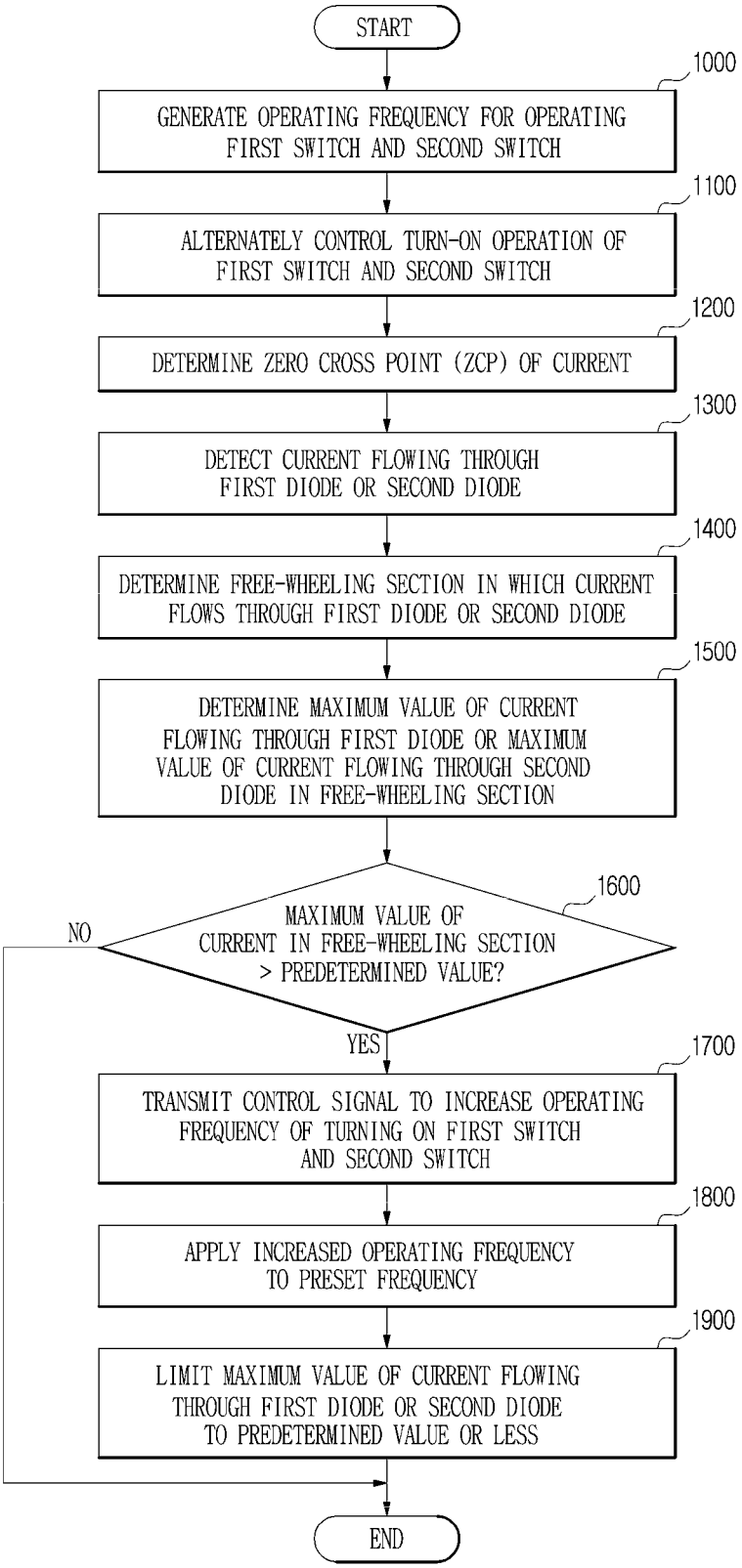
FIG. 12 is a flowchart illustrating a method of controlling a cooking apparatus according to an embodiment.
Figure 13:
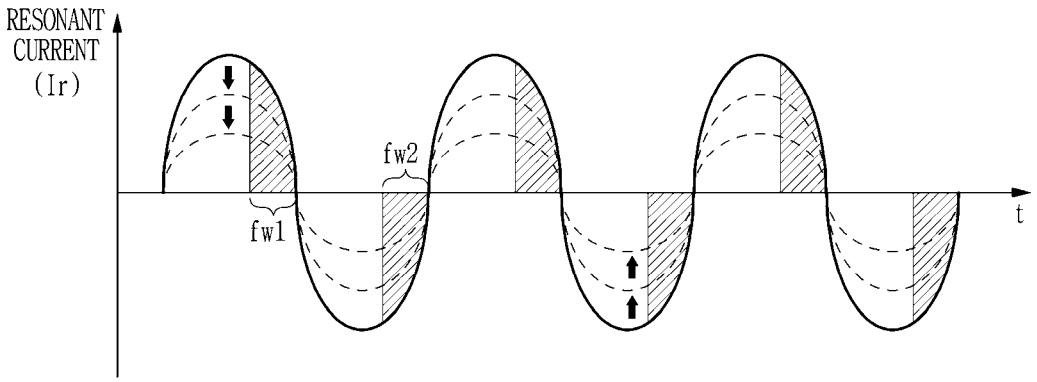
FIG. 13 is a conceptual view illustrating a change in current magnitude according to a frequency control of a cooking apparatus according to an embodiment.

FIG. 4 is a control block diagram of a cooking apparatus according to an embodiment. FIG. 5 is a view illustrating a detailed configuration of a driving circuit provided in a cooking apparatus according to an embodiment. FIGS. 6 to 9 are views illustrating a current flow of a driving circuit by switching according to an embodiment. FIG. 10 is an exemplary view of a current waveform according to a frequency of a cooking apparatus according to an embodiment. FIG. 11 is an exemplary view of a free-wheeling section of a current by switching according to an embodiment. FIG. 12 is a flowchart illustrating a method of controlling a cooking apparatus according to an embodiment. FIG. 13 is a conceptual view illustrating a change in current magnitude according to a frequency control of a cooking apparatus according to an embodiment.

Referring to FIG. 4, the cooking apparatus 100 may include the user interface 130, the coil device 140, and the driving circuit 150.

The user interface 130 may include an inputter 131 receiving the operation command of the cooking apparatus 100 and a display 132 outputting the operation information of the cooking apparatus 100.

Here, the operation command may include the power on/off command, a coil selection command (that is, a cooking position selection command), a coil output level selection command, an operation start command, and an operation reservation command. The operation information may include the power on/off information, the coil selection information, the coil output level information, and cooking progress information.

When the driving circuit 150 is powered on and a position selection signal and an operation start signal of at least one coil are input, the current may be supplied to the selected at least one coil so that the vessel can be heated to a selected output level through the selected at least one coil.

The driving circuit 150 may adjust a magnitude of the current applied to the coil based on the selection signal of the output level of the coil.

Here, the output level is a discretely classification of an intensity of the magnetic field B generated by each of the coils 141, 142, 143, and 144, and the higher the output level, the greater the coil generates the magnetic field B, allowing the vessel 200 to be heated to a faster and higher temperature.

In addition, when the position selection signal of the coil is received, the driving circuit 150 may recognize a time at which the position selection signal of the coil is received as an operation start time, and may supply the current to the coil. When the selection signal of the output level is received, the driving circuit 150 may recognize a time at which the selection signal of the output level is received as the operation start time, and may supply the current to the coil.

The cooking apparatus 100 may further include a temperature detector (not shown) provided around each of the plurality of coils. In this case, the driving circuit 150 may adjust the magnitude of the current applied to the coil based on the detected temperature.

The driving circuit 150 will be described with reference to FIG. 5.

Referring to FIG. 5, the driving circuit 150 may include a power supply 151, a rectifier 152, a smoother 153, a driver 154, a current detector 155, a controller 156, and a storage 157.

The power supply 151 may be connected to an external commercial power source and receive power from the commercial power source.

The power supply 151 may include a power switch, and when a power-on signal is received through the inputter 131, the power supply 151 may turn on the power switch to be connected to the external commercial power source.

In addition, the power supply 151 may be transmitted to the rectifier 152 after removing noise of the external commercial power.

The rectifier 152 may receive power from the power supply 151 and rectify the power, and may transmit the rectified power to the smoother 153.

The rectifier 152 may include at least one diode, or may include a bridge diode.

The smoother 153 may remove a ripple of the rectified power from the rectifier 152 and transmit the power from which the ripple is removed to the driver 154.

That is, the smoother 153 may convert DC power by removing pulsation among the applied power and transmit the converted DC power to driving power of the driver 154.

When the power is supplied from the smoother 153, the driver 154 may supply the supplied power to at least one coil.

Here, the number of the drivers 154 may be the same as the number of coils.

For example, if there is one coil provided in the cooking apparatus 100, there is one of the drivers 154, and if there are four coils provided in the cooking apparatus 100, there are four of the drivers 154.

When there are a plurality of the drivers 154, the plurality of drivers 154 may be connected to the plurality of coils, respectively, and may supply the power to the coils connected to each of the plurality of drivers 154.

That is, the plurality of drivers 154 may operate independently of each other based on the position selection signal of the coil.

Since the configuration of the drivers 154 connected to each of the coils is the same, the embodiment describes the driver 154 connected to the first coil 141 as an example.

The driver 154 may be connected between both ends of the smoother 153, and may include a first switch Q1 and a second switch Q2 receiving an operation signal from the controller 156, and a first diode D1 connected in parallel to the first switch Q1 and a second diode D2 connected in parallel to the second switch Q2, and first and second capacitors C1 and C2 connected between both ends of the smoother 153.

The first diode D1 and the second diode D2 may be connected to the first switch Q1 and the second switch Q2 in parallel, respectively. The first diode D1 and the second diode D2 are diodes where currents flow in an opposite direction to the currents flowing in the first switch Q1 and the currents flowing in the second switch Q2, and may have properties of an anti-parallel diode. At this time, the anti-parallel diode may be referred to as a free-wheeling diode, and the current flowing through the free-wheeling diode may be referred to as a free-wheeling current.

The first switch Q1 and the second switch Q2 each includes a gate terminal connected to the controller 156, and may be turned on by receiving a turn-on signal through the gate terminal or turned off by receiving a turn-off signal.

Here, the first switch Q1 and the second switch Q2 may be turned on alternately. That is, when the first switch Q1 is turned on, the second switch Q2 may be turned off, and when the first switch Q1 is turned off, the second switch Q2 may be turned on.

The driver 154 may be provided in a form of a half bridge.

The first and second capacitors C1 and C2 may be connected in parallel with a pair of the first switch Q1 and the second switch Q2.

Both ends of the first coil 141 of the coil device 140 may be connected to a node to which the pair of switches Q1 and Q2 are connected in series and a node to which a pair of the capacitors C1 and C2 are connected in series.

The first coil 141 may form a resonant circuit together with the first and second capacitors C1 and C2.

A current IL of the first coil 141 may resonate according to a predetermined period.

Here, the predetermined period may be determined according to time constants of the first coil 141 and the first and second capacitors C1 and C2.

The first coil 141 may generate a high-frequency magnetic field using operating frequencies of the first switch Q1 and the second switch Q2.

The driver 154 may supply the current in which the direction changes to the first coil 141 according to turn on and turn off operations of the first switch Q1 and the second switch Q2.

That is, when the first switch Q1 is turned on and the second switch Q2 is turned off, the driving current in a first direction may be supplied to the first coil 141. When the first switch Q1 is turned off and the second switch Q2 is turned on, the driving current in the second direction may be supplied to the first coil 141.

Figure 6:
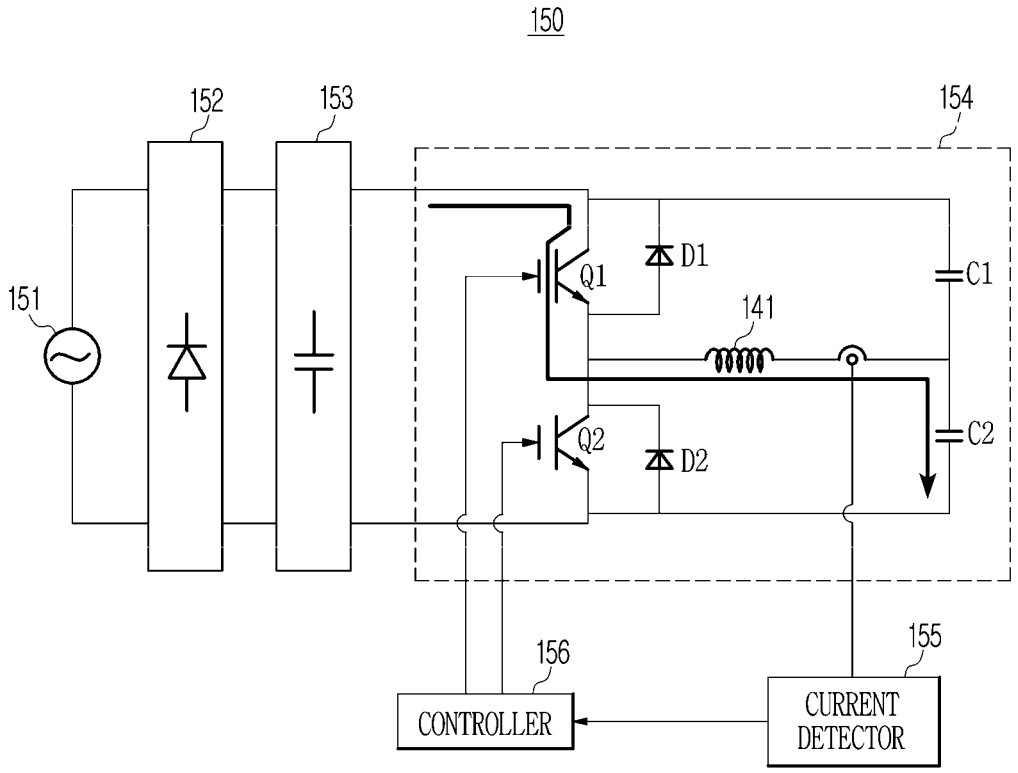
FIGS. 6 to 9 are views illustrating a current flow of a driving circuit by switching according to an embodiment.

Referring to FIGS. 6 and 11, when the first switch Q1 is turned on and the second switch Q2 is turned off, the driving current supplied in the first direction may flow through the first switch Q1 and the first coil 141 toward the second capacitor C2.

Referring to a graph of a resonant current waveform of FIG. 11, in section ① (t1~t2) in which the first switch Q1 is turned on and the second switch Q2 is turned off, the driving current may be supplied in the first direction and flow to the first switch Q1 and the first coil 141.

Figure 7:
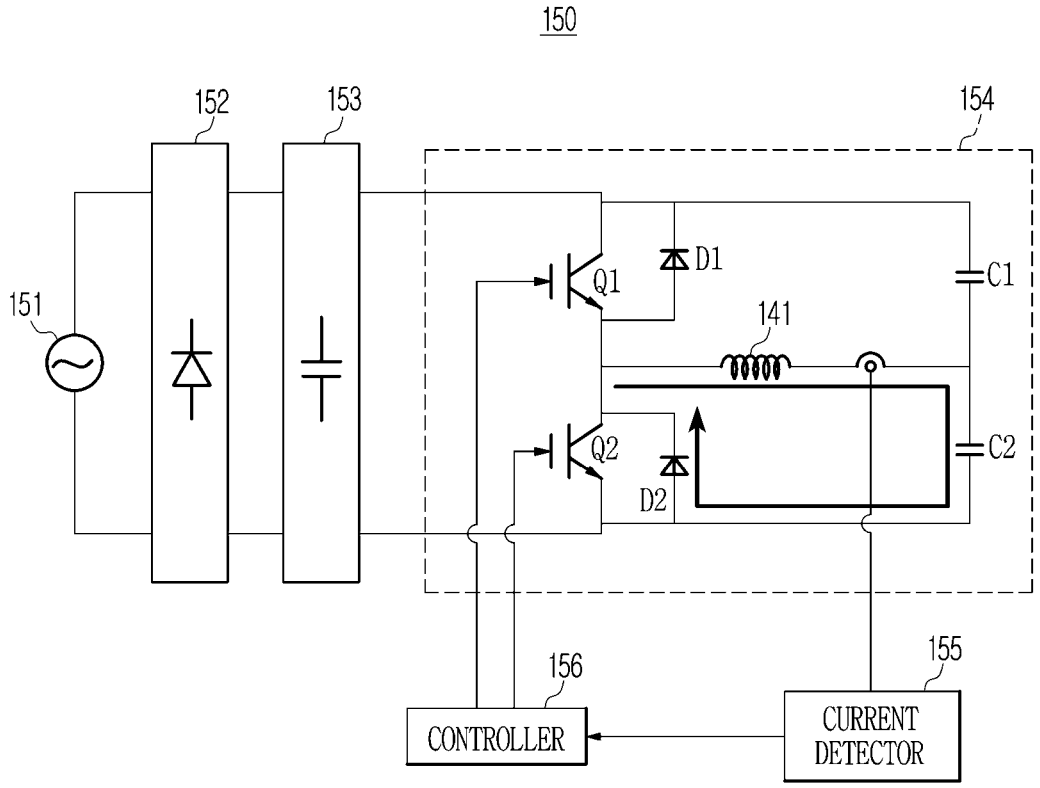

Referring to FIGS. 7 and 11, when the first switch Q1 is turned off and the second switch Q2 is turned on, the driving current supplied in the first direction may flow through the first coil 141 and the second capacitor C2 toward the second diode D2.

That is, when the first switch Q1 is turned off in a turn-on state, and the second switch Q2 is turned on in a turn-off state, the driving current accumulated in the first coil 141 flowing in the first direction as illustrated in FIG. 6 is free-wheeling while flowing toward the second diode D2 for a predetermined time as illustrated in FIG. 7.

That is, since the first coil 141 is an inductor element, the first coil 141 has a property of maintaining the direction in which the current flows and continuously flowing in the same direction. In this case, the current flowing toward the second diode D2 may be referred to as the free-wheeling current.

In this case, a dead time of a predetermined time may occur between the times when the first switch Q1 is turned off in the turn-on state and the second switch Q2 is turned on in the turn-off state. However, for convenience of description, it is assumed that there is no dead time.

Referring to the graph of a resonant current waveform of FIG. 11, in section ② (t2~t3) in which the first switch Q1 is turned off and the second switch Q2 is turned on, the driving current may be supplied in the first direction and free-wheeling while flowing toward the second diode D2. That is, the section ② in FIG. 11 may correspond to a free-wheeling section in which the driving current flows in the second diode D2.

Figure 8:
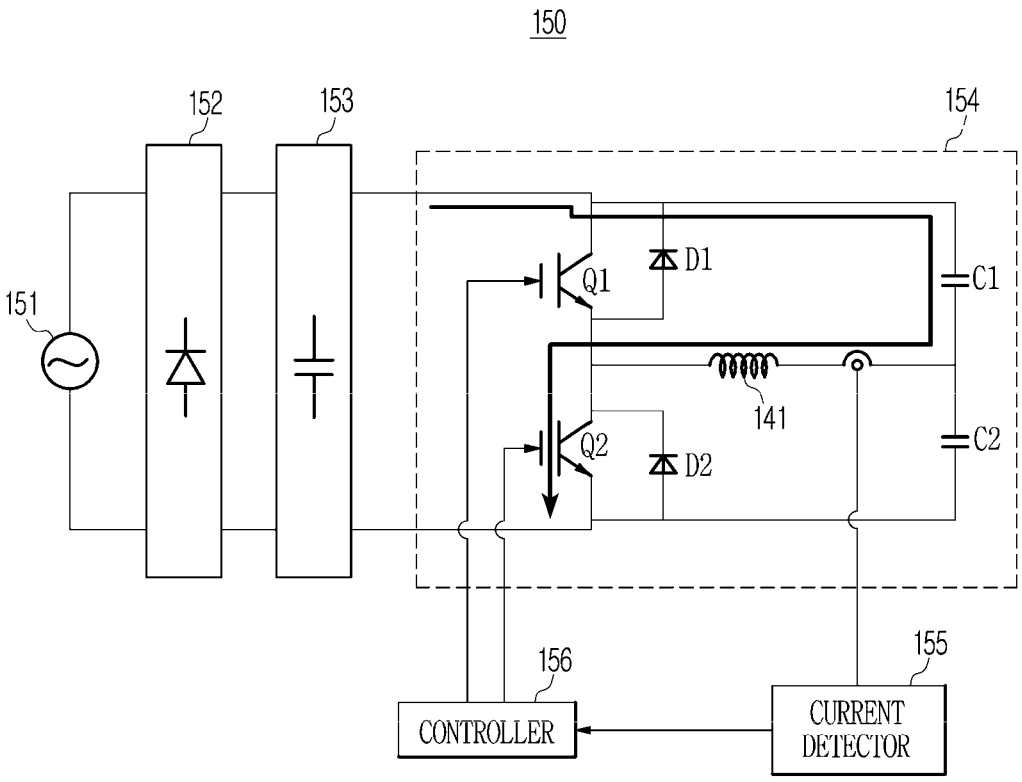

Referring to FIGS. 8 and 11, when the first switch Q1 is turned off and the second switch Q2 is turned on, the driving current supplied in the second direction may flow through the first capacitor C1 and the first coil 141 toward the second switch Q2.

In section ③ (t3~t4) in which the first switch Q1 is turned off and the second switch Q2 is turned on, the driving current may be supplied in the second direction and flow toward the second switch Q2.

Figure 9:
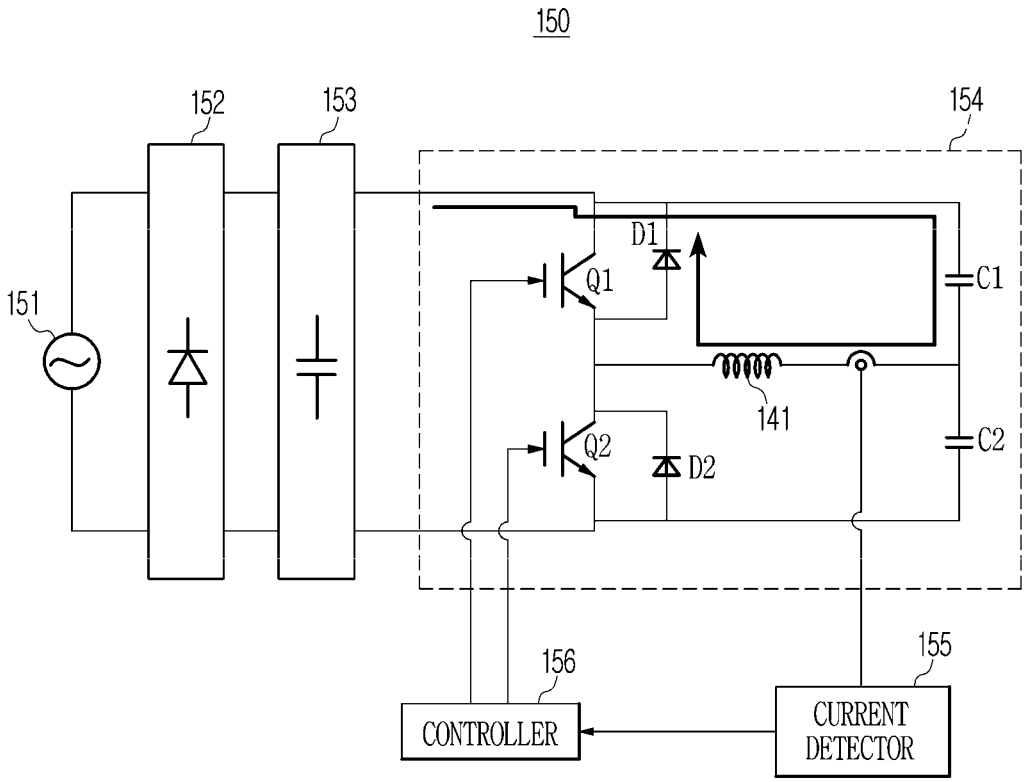

Referring to FIGS. 9 and 11, when the first switch Q1 is turned on and the second switch Q2 is turned off, the driving current supplied in the second direction may flow through the first capacitor C1 and the first coil 141 toward the first diode D1.

That is, when the first switch Q1 is turned on in the turn-off state, and the second switch Q2 is turned off in the turn-on state, the driving current accumulated in the first coil 141 flowing in the second direction as illustrated in FIG. 8 is free-wheeling while flowing toward the first diode D1 for the predetermined time as illustrated in FIG. 9. Even in this case, the dead time of the predetermined time may occur between the times when the first switch Q1 is turned on in the turn-off state and the second switch Q2 is turned off in the turn-on state. However, for convenience of description, it is assumed that there is no dead time.

Referring to the graph of a resonant current waveform of FIG. 11, in section ④ (t4~t5) in which the first switch Q1 is turned on and the second switch Q2 is turned off, the driving current may be supplied in the second direction and free-wheeling while flowing toward the first diode D1. That is, the section ED in FIG. 11 may correspond to the free-wheeling section in which the driving current flows in the first diode D1.

As illustrated in FIGS. 7 and 9, when the driving current flows through the first diode D1 or the second diode D2, if the magnitude of the driving current is greater than the rating of the first diode D1 or the second diode D2, there is a risk that the first diode D1 or the second diode D2 is damaged.

Accordingly, according to the cooking apparatus 100 and a method of controlling the cooking apparatus 100 according to the embodiment, the free-wheeling section in which the driving current flows through the first diode D1 or the second diode D2 is determined, and the maximum value of the current flowing through the first diode D1 or the second diode D2 in the free-wheeling section may be limited to within the rating of the element.

The current detector 155 may be connected to the first coil 141, and may detect the current flowing through the first coil 141 and transmit the detected current information to the controller 156.

For example, the current detector 155 may include a current transformer (CT) that decreases in proportion to the magnitude of current supplied to the first coil 141 and an ampere meter that detects the magnitude of a proportionally reduced current.

As another example, the current detector 155 may include a shunt resistance connected to the first coil 141 and a measuring instrument (not shown) that measures a voltage drop generated by the shunt resistance.

Also, the current detector 155 may detect the current flowing through the first diode D1 or the second diode D2 and transmit the detected current information to the controller 156.

The driving circuit 150 may further include a gate driver (not shown) that generates a gate signal for turning on and off the first switch Q1 and the second switch Q2 according to the command of the controller 156.

Here, the gate driver may be provided integrally with the controller 156 or separately from the controller 156.

In addition, when the gate driver is provided separately from the controller, the controller 156 may include a communication interface for communication with the gate driver.

A signal generator 158 may generate the operating frequencies for operating the first switch Q1 and the second switch Q2. In addition, the signal generator 158 may generate an increased operating frequency to a preset value under the control of the controller 156 and apply the increased operating frequency to the gate terminal of the first switch Q1 and the gate terminal of the second switch Q2.

When the selection signal of the output level and the position selection information of the coil are received, the controller 156 may transmit a control signal to the driver 154 to supply the current corresponding to the selected output level to the selected coil.

When the control signal is transmitted to the driver 154, the controller 156 may transmit the control signal for alternately controlling the turn-on operation of the first switch Q1 and the second switch Q2.

The controller 156 may change the periods of turn-on and turn-off of the first switch Q1 and the second switch Q2 to apply the current corresponding to the selected output level to the first coil 141. The magnitude of the current supplied to the first coil 141 may be changed.

Here, the periods of turn-on and turn-off of the first switch Q1 and the second switch Q2 may be determined according to the frequency.

In addition, the controller 156 may control pulse width modulation (PWM) for turn-on and turn-off of the first and second switches Q1 and Q2 based on a temperature of the coil.

Referring to FIG. 10, when the first switch Q1 and the second switch Q2 are operated for the predetermined time by predetermined operating frequencies F1 and F2, amplitudes of waveforms P1 and P2 of the current flowing through the first coil 141 may be changed by the overlapping of the frequency due to turn-on and turn-off of the first switch Q1 and the second switch Q2 and a resonant frequency of the resonant circuit (i.e., the first coil and the first and second capacitors).

Hereinafter, the coil device 140 and a method of controlling the coil device 140 according to the embodiment will be described in time series based on FIGS. 11 to 13.

The signal generator 158 may generate the operating frequency for operating the first switch Q1 and the second switch Q2 under the control of the controller 156 (1000), and may apply the operating frequency to the gate terminal of the first switch Q1 and the gate terminal of the second switch Q2.

That is, the controller 156 may control the signal generator 158 to alternately control the turn-on operation of the first switch Q1 and the second switch Q2 (1100).

Referring to FIG. 11, the first switch Q1 and the second switch Q2 may alternately turn on and off, and accordingly, the direction of the driving current flowing through the driver 154 may be changed.

The controller 156 may obtain a current waveform of one cycle whose amplitude is the maximum among the waveforms of the current flowing through the first coil 141 by the operation of the first switch Q1 and the second switch Q2, and may determine a zero cross point (ZCP) among the obtained current waveforms of one cycle (1200).

The controller 156 may control the current detector 155 to detect the current flowing in the driver 154 by turning on and off the first switch Q1 and the second switch Q2. That is, the controller 156 may detect the current flowing through the first coil 141, and may detect the current flowing through the first diode D1 or the current flowing through the second diode D2 (1300).

The controller 156 may determine the free-wheeling section in which the current flows through the first diode D1 or the second diode D2 based on a time point at which the first switch Q1 and the second switch Q2 alternately turn on and the zero cross point (ZCP) (1400).

Referring to FIG. 11, the controller 156 may determine from a turn-off point t2 of the first switch Q1 to an end point t3 of the ZCP as the free-wheeling section based on a current phase at the turn-off point t2 of the first switch Q1 and the current phase of the end point t3 of the ZCP.

That is, in the graph of the resonant current waveform of FIG. 11, the section ② (t2~t3) may correspond to the free-wheeling section in which the current flows through the second diode D2 as described above in FIG. 7.

In addition, referring to FIG. 11, the controller 156 may determine from a turn-off point t4 of the second switch Q2 to a start point t5 of the ZCP as the free-wheeling section based on the current phase at the turn-off point t4 of the second switch Q2 and the current phase of the start point t5 of the ZCP.

That is, in the graph of the resonant current waveform of FIG. 11, the section ④ (t4~t5) may correspond to the free-wheeling section in which the current flows through the first diode D1 as described above in FIG. 9.

The controller 156 may control the maximum value of the current flowing through the first diode D1 or the maximum value of the current flowing through the second diode D2 in the free-wheeling section in order to limit the current flowing through the first diode D1 or the second diode D2 in the free-wheeling section to below the rating (1500).

Referring to FIG. 11, the controller 156 may determine the maximum value of the free-wheeling current in the free-wheeling section based on the current value flowing through the first diode D1 or the second diode D2 detected in the section ② (t2~t3) and the section ④ (t4~t5) corresponding to the free-wheeling section.

In the free-wheeling section, the controller 156 may compare the maximum value of the free-wheeling current flowing through the first diode D1 or the maximum value of the free-wheeling current flowing through the second diode D2 with a predetermined value (1600). When the maximum value of the free-wheeling current exceeds the predetermined value, the controller 156 may transmit the control signal that controls the signal generator 158 so that the operating frequency of turning on the first switch Q1 and the second switch Q2 is increased (1700).

When the free-wheeling current flows through the first diode D1 and the second diode D2, the predetermined current values may be stored in the storage 157 based on the rating of the element so that the first diode D1 and the second diode D2 are not damaged. In addition, in order to limit the maximum value of the free-wheeling current to the predetermined value or less, data on the value of increasing the operating frequency of the first switch Q1 and the second switch Q2 may also be stored in the storage 157.

The signal generator 158 may generate the increased operating frequency at a preset frequency based on the control signal transmitted by the controller 156 to apply the increased operating frequency to the gate terminal of the first switch Q1 and the gate terminal of the second switch Q2 (1800).

That is, the controller 156 may limit the maximum value of the current flowing through the first diode D1 or the second diode D2 to the predetermined value or less by increasing the operating frequency for operating the first switch Q1 and the second switch Q2 (1900).

Referring to FIG. 13, as the controller 156 increases the operating frequency of operating the first switch Q1 and the second switch Q2, the magnitude of the resonance current flowing through the cooking apparatus 100 decreases. Therefore, as illustrated in FIG. 13, since the maximum values of the currents flowing in the first diode D1 and the second diode D2 in free-wheeling sections fw1 and fw2 are also reduced, the controller 156 may limit the free-wheeling current to the predetermined current value or less according to the rating of the element.

In addition, the controller 156 may determine whether the free-wheeling current is greater than or equal to the predetermined value based on a Root Mean Square (RMS) current rather than the maximum value of the current flowing through the first diode D1 or the second diode D2. When the free-wheeling current is greater than or equal to the predetermined value, the controller 156 may limit the free-wheeling current to the predetermined value or less by controlling the operating frequency.

The controller 156 is a memory (not shown) that stores data for an algorithm for controlling the operation of the components in the cooking apparatus 100 or a program that reproduces the algorithm, and a processor (not shown) that performs the above-described operation using the data stored in the memory. At this time, the memory and the processor may be implemented as separate chips, respectively. Alternatively, the memory and the processor may be implemented as a single chip.

The storage 157 may be implemented using at least one of a non-volatile memory element, e.g., cache, Read Only Memory (ROM), Programmable ROM (PROM), Erasable Programmable ROM (EPROM), Electrically Erasable Programmable ROM (EEPROM) and flash memory; a volatile memory element, e.g., Random Access Memory (RAM); or a storage medium, e.g., a Hard Disk Drive (HDD) and CD-ROM. The implementation of the storage is not limited thereto. The storage 157 may be a memory that is implemented by a separate memory chip from the aforementioned processor related to the controller 156 or the storage may be implemented by a single chip with the processor.

Figure 14:
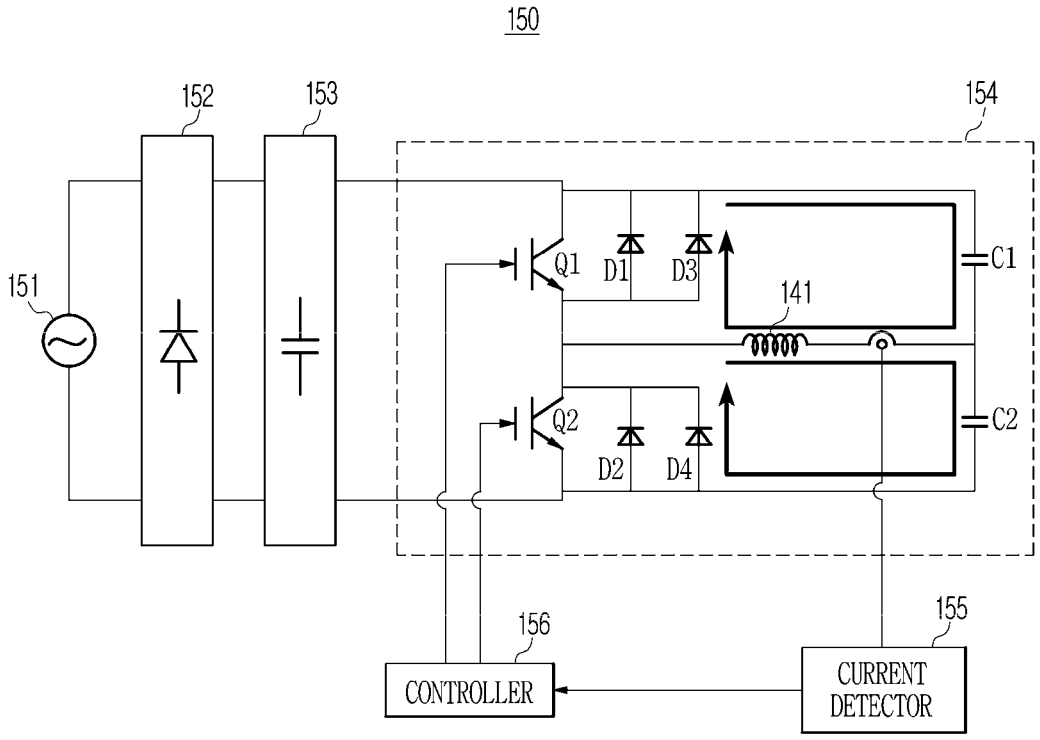
FIGS. 14 and 15 are conceptual views for a method of increasing the rating of a diode provided in a cooking apparatus according to an embodiment.
Figure 15:
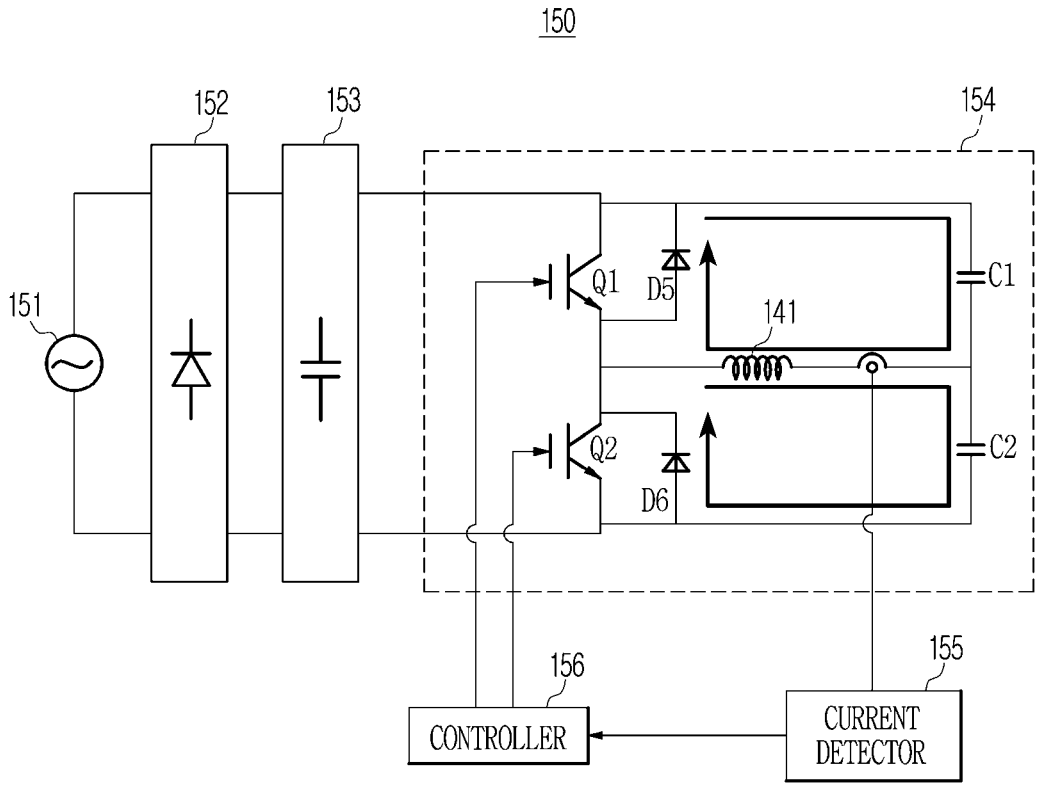

FIGS. 14 and 15 are conceptual views for a method of increasing the rating of a diode provided in a cooking apparatus according to an embodiment.

As described above, when the free-wheeling current flowing through the first diode D1 or the second diode D2 provided in the cooking apparatus 100 exceeds the predetermined value, problems such as the risk of damage to the element may occur. Accordingly, the controller 156 may control the operating frequencies of the first switch Q1 and the second switch Q2 to limit the free-wheeling current to the predetermined value or less.

On the other hand, in order to further secure the rating of the free-wheeling current flowing through the cooking apparatus 100, as illustrated in FIG. 14, a third diode D3 connected in parallel with the first diode D1 may be added, and a fourth diode D4 connected in parallel with the second diode D2 may be added.

That is, when the third diode D3 and the fourth diode D4 are connected in parallel, since the magnitude of the current flowing through the first diode D1 to the fourth diode D4 of the cooking apparatus 100 increases, the stress caused by the current above the rating may be reduced by the effect that the rating of the element increases.

In addition, in order to further secure the rating of the free-wheeling current flowing through the cooking apparatus 100, as illustrated in FIG. 15, a fifth diode D5 having a greater rated capacity for the free-wheeling current than the first diode D1 may be connected in parallel to the first switch Q1. Similarly, a sixth diode D6 having a greater rated capacity for the free-wheeling current than the second diode D2 may be connected in parallel to the second switch Q2.

That is, when the fifth diode D5 and the sixth diode D6 having the increased rated capacity are connected to the first switch Q1 and the second switch Q2, respectively, since the magnitude of the current flowing through the fifth diode D5 and the sixth diode D6 of the cooking apparatus 100 increases, the stress caused by the current above the rating may be reduced by the effect that the rating of the element increases.

As described above, according to the cooking apparatus and the method of controlling the cooking apparatus of the embodiments, there is an effect of detecting a current flowing through a diode included in a cooking apparatus and limiting the current within the rating when a current greater than the diode's rating flows, thereby reducing stress caused by the current flowing through an element. In addition, by limiting the current flowing to the element within the rating for various cooking apparatuses, there is an effect that secures stability and is independent of a size and type of the cooking apparatus.

Meanwhile, the disclosed embodiments may be implemented in the form of a recording medium storing instructions that are executable by a computer. The instructions may be stored in the form of a program code, and when executed by a processor, the instructions may generate a program module to perform operations of the disclosed embodiments. The recording medium may be implemented as a computer-readable recording medium.

The computer-readable recording medium may include all kinds of recording media storing commands that can be interpreted by a computer. For example, the computer-readable recording medium may be read only memory (ROM), random access memory (RAM), a magnetic tape, a magnetic disc, flash memory, an optical data storage device, etc.

Although the present disclosure has been described with various embodiments, various changes and modifications may be suggested to one skilled in the art. It is intended that the present disclosure encompass such changes and modifications fall within the scope of the appended claims.

The invention claimed is:

1. A cooking apparatus comprising:

a coil on which a vessel is mounted, configured to form a magnetic field upon application of a current;

a first switch and a second switch configured to change a direction of the current flowing through the coil;

a first diode connected in parallel to the first switch and a second diode connected in parallel to the second switch; and a controller configured to:

alternately control a turn-on operation of the first switch and the second switch, and when a maximum value of the current flowing through the first diode or a maximum value of the current flowing through the second diode exceeds a predetermined value, limiting the maximum value of the current flowing through the first diode or the second diode to less than or equal to the predetermined value by increasing an operating frequency of alternately turning on the first switch and the second switch.

2. The cooking apparatus according to claim 1, wherein the controller is configured to determine a zero cross point (ZCP) of the current flowing through the coil.

3. The cooking apparatus according to claim 2, wherein the controller is configured to determine a free-wheeling section in which the current flows in the first diode or the second diode based on a point at which the first switch and the second switch alternately turn on and the determined ZCP.

4. The cooking apparatus according to claim 3, wherein the controller is configured to determine from a turn-off point of the first switch to an end point of the ZCP as the free-wheeling section in which the current flows in the second diode based on a current phase at the turn-off point of the first switch and a current phase at the end point of the ZCP.

5. The cooking apparatus according to claim 3, wherein the controller is configured to determine from a turn-off point of the second switch to a start point of the ZCP as the free-wheeling section in which the current flows in the first diode based on a current phase at the turn-off point of the second switch and a current phase at the start point of the ZCP.

6. The cooking apparatus according to claim 3, wherein the controller is configured to determine the maximum value of the current flowing through the first diode or the maximum value of the current flowing through the second diode in the free-wheeling section, and to compare the maximum value of the determined current with the predetermined value.

7. The cooking apparatus according to claim 6, further comprising:

a current detector configured to detect the current flowing in the coil, wherein the current detector is configured to detect the maximum value of the current flowing through the first diode or the maximum value of the current flowing through the second diode in the free-wheeling section.

8. The cooking apparatus according to claim 1, further comprising:

a signal generator configured to generate an operating frequency for operating the first switch and the second switch.

9. The cooking apparatus according to claim 8, wherein the signal generator is configured to generate an increased operating frequency at a preset frequency under the control of the controller, and to apply the increased operating frequency to a gate end of the first switch and a gate end of the second switch.

10. The apparatus of claim 1, further comprising:

a current detector configured to detect the current flowing in the coil, wherein the current detector includes:

a current transformer that decreases in proportion to a magnitude of current supplied to the first coil, and an ampere meter that detects the magnitude of a proportionally reduced current.

11. A method of controlling a cooking apparatus, the cooking apparatus including a coil configured to form a magnetic field according to an application of a current, the method comprising:

alternately controlling, by a controller, a turn-on operation of a first switch and a second switch;

determining, by the controller, a maximum value of the current flowing through a first diode connected in parallel to the first switch or a maximum value of the current flowing through a second diode connected in parallel to the second switch; and when the maximum value of the determined current exceeds a predetermined value, limiting the maximum value of the current flowing through the first diode or the second diode to less than or equal to the predetermined value by increasing, via the controller, an operating frequency of alternately turning on the first switch and the second switch.

12. The method according to claim 11, further comprising:

determining, by the controller, a zero cross point (ZCP) of the current flowing through the coil.

13. The method according to claim 12, further comprising:

determining, by the controller, a free-wheeling section in which the current flows in the first diode or the second diode based on a point at which the first switch and the second switch alternately turn on and the determined ZCP.

14. The method according to claim 13, wherein the determining of the free-wheeling section comprises:

determining from a turn-off point of the first switch to an end point of the ZCP as the free-wheeling section in which the current flows in the second diode based on a current phase at the turn-off point of the first switch and a current phase at the end point of the ZCP; and determining from a turn-off point of the second switch to a start point of the ZCP as the free-wheeling section in which the current flows in the first diode based on a current phase at the turn-off point of the second switch and a current phase at the start point of the ZCP.

15. The method according to claim 13, wherein the determining of the maximum value of the current comprises:

determining the maximum value of the current flowing through the first diode or the maximum value of the current flowing through the second diode in the free-wheeling section; and comparing the maximum value of the determined current with the predetermined value.

16. The method according to claim 15, further comprising:

detecting, by a current detector, the current flowing in the coil, wherein the detecting of the current comprises detecting the maximum value of the current flowing through the first diode or the maximum value of the current flowing through the second diode in the free-wheeling section.

* * * * *